US009527187B2

(12) United States Patent
Burner et al.

(10) Patent No.: US 9,527,187 B2
(45) Date of Patent: Dec. 27, 2016

(54) TOOL OPERATING ASSEMBLY FOR A LENS SHAPING MACHINE

(71) Applicants: Richard L. Burner, Pinellas Park, FL (US); Alan Hodges, Pinellas Park, FL (US)

(72) Inventors: Richard L. Burner, Pinellas Park, FL (US); Alan Hodges, Pinellas Park, FL (US)

(73) Assignee: ASSOCIATED DEVELOPMENT CORPORATION, Pinellas Park, FL (US)

( * ) Notice: Subject to any disclaimer, the term of this patent is extended or adjusted under 35 U.S.C. 154(b) by 493 days.

(21) Appl. No.: 13/987,933

(22) Filed: Sep. 17, 2013

(65) Prior Publication Data

US 2014/0080386 A1 Mar. 20, 2014

Related U.S. Application Data

(60) Provisional application No. 61/744,166, filed on Sep. 19, 2012.

(51) Int. Cl.

| | |
|---|---|
| ***B24B 13/005*** | (2006.01) |
| ***B24B 9/14*** | (2006.01) |
| ***B24B 51/00*** | (2006.01) |
| ***B24B 13/00*** | (2006.01) |
| ***B24B 27/00*** | (2006.01) |

(52) U.S. Cl.

CPC ..... *B24B 51/00* (2013.01); *B24B 9/14* (2013.01); *B24B 13/0037* (2013.01); *B24B 13/0055* (2013.01); *B24B 27/0061* (2013.01)

(58) Field of Classification Search

CPC .... B24B 13/0055; B24B 13/0037; B24B 9/14; B24B 9/142

USPC ..... 451/42, 43, 44, 294

See application file for complete search history.

(56) References Cited

U.S. PATENT DOCUMENTS 5,974,643 A * 11/1999 Hays ..... B23Q 17/2233 29/39

2010/0009603 A1* 1/2010 Nauche ..... B24B 9/14 451/43

* cited by examiner

*Primary Examiner* — Monica Carter
*Assistant Examiner* — Lauren Beronja
(74) *Attorney, Agent, or Firm* — Arthur Fisher

(57) ABSTRACT

A tool operating assembly for a lens shaping machine to finish the peripheral edge of a corrective lens wherein the tool operating assembly is disposed in operative relationship relative to a lens operating assembly comprising a lens support assembly to support the corrective lens to be finished and a multi-axis lens positioning assembly to move the corrective lens relative to the tool operating assembly during the finishing operation to finish the peripheral edge of the corrective lens, the tool operating assembly comprising a multi-station tool support assembly to selectively position one of a plurality of tools in operative position to engage the peripheral edge of the corrective lens to be finished and a tool drive assembly to rotate the selected tool during the finishing operation to finish the peripheral edge of the corrective lens.

26 Claims, 5 Drawing Sheets

TOOL OPERATING ASSEMBLY FOR A LENS SHAPING MACHINE

CROSS-REFERENCE

This application claims priority of provisional application Ser. No. 61/744,166 filed Sep. 19, 2012.

BACKGROUND OF THE INVENTION

Field of the Invention

A tool operating assembly for a lens shaping machine to finish the peripheral edge of a corrective lens.

Description of the Prior Art

Numerous machines have been designed to shape and finish eye lens. Several examples of grinding or polishing machines including multiple tools are disclosed in the prior art patents referred to herein.

U.S. Pat. No. 2,485,332 shows a shoe finishing or repairing machine comprising a number of shoe finishing or repairing tools for finishing or repairing operations. The tools are selectively movable to a particular position so that less space is required for operator.

U.S. Pat. No. 2,707,855 relates to a multiple grinding machine to provide a grinder having a series of grinding wheels. The device provides a common operating means for all of the grinding wheels with control means operative to apply power only to the grinding wheel disposed at the grinding station while all of the other grinding wheels are inactive.

U.S. Pat. No. 4,481,739 shows a grinding machine comprising a pair of wheel slides disposed respectively at both sides of a work support to be movable toward and away from the work table in a first direction. The wheel slides carry turrets in such a manner that each of the turrets is rotationally indexed about and slidable along an axis thereof extending in a second direction perpendicular to the first direction. Each of the turrets carries a plurality of grinding wheels which are rotatable and when rotationally indexed selectively presents the grinding wheels to a machining station. The position of a selected one of the grinding wheels relative to a workpiece on the work support is adjusted in the first direction through the movement of each wheel slide and in the second direction through the movement of each turrets.

U.S. Pat. No. 4,922,595 discloses a turret head unit comprising a turret head in combination with a plurality of angularly disposed tool receiving spindles and a spindle drive shaft rotatably mounted in the turret head. A clutch is mounted on the spindle drive shaft and movable into and out of driving engagement with a tool receiving spindle in a working position.

Additional examples are found in the following patents: U.S. Pat. No. 2,493,206; U.S. Pat. No. 4,461,121; U.S. Pat. No. 4,617,764; U.S. Pat. No. 4,662,119; U.S. Pat. No. 4,833,764; U.S. Pat. No. 5,820,537; U.S. Pat. No. 5,951,376; U.S. Pat. No. 6,250,999; U.S. Pat. No. 6,383,061; U.S. Pat. No. 7,413,502; U.S. Pat. No. 7,422,510; U.S. Pat. No. 7,455,569; U.S. Pat. No. 7,597,033; U.S. Pat. No. 7,614,742 and U.S. Pat. No. 7,739,778.

While some of the prior art may contain some similarities relating to the present invention, none of them teach, suggest or include all of the advantages and unique features of the invention disclosed hereafter.

SUMMARY OF THE INVENTION

The present invention relates to a tool operating assembly for a lens shaping machine including a lens operating assembly to finish the peripheral edge or edge portion of a corrective lens.

The lens operating assembly comprises a lens support assembly to support the corrective lens to be finished and a multi-axis lens positioning assembly to move the corrective lens supported relative to the tool operating assembly during the finishing operation.

The tool operating assembly comprises a multi-station tool support assembly to selectively position one of a plurality of tools at a finishing station or location to engage the peripheral edge or edge portion of the corrective lens to be finished, a tool drive assembly to rotate the selected tool positioned at the finishing station or location during the finishing operation and a clutch assembly to operatively couple the selected tool and the tool drive assembly to rotate the selected tool during the finishing operation.

The multi-station tool support assembly comprises a turret or turn-table having a plurality of tool assemblies rotatably mounted thereto on a drive shaft coupled to a step motor to selectively position one of the tools at the finishing position or station.

Each tool assembly comprises a tool holder formed in the lower portion thereof to couple a tool thereto and a lower drive or clutch element on the upper portion of the corresponding tool holder to engage a similarily configured upper drive or clutch element when the selected tool assembly is located or positioned at the finishing station to cooperatively form a portion of the clutch assembly to rotate the selected tool to finish the peripheral edge or edge portion of the corrective lens.

The multi-station tool support assembly further includes a turret lock to lock the turret or turn-table against rotation when in the locked position and the appropriate or selected tool and tool assembly are positioned or located at the finishing station.

A tool position sensing device is positioned or disposed adjacent each tool assembly each having a discrete identifier to cooperate with a tool assembly position sensing device disposed adjacent the finishing station to indicate the rotational position of the turret or turn-table and the tool assemblies relative to the finishing station to assure the selected tool is positioned or located at the finishing station.

The tool drive assembly comprises a tool drive shaft disposed in vertical alignment relative to the finishing station having the upper drive or clutch element coupled to the lower portion thereof and movable between an upper position and a lower position by a clutch positioning device such that the upper drive or clutch element engages the lower drive or clutch element of the tool assembly located or positioned at the finishing station when the tool drive shaft is in the lower position. The substantially vertical tool drive shaft is coupled to the output shaft of a tool drive motor by a drive linkage.

Since the turret or turn-table is driven or rotated by a step motor, the turret or turn-table is incrementally advanced from one tool assembly to the next tool assembly until the selected tool is sensed by the tool sensing device and tool assembly position sensing device as positioned or located at the finishing station aligning the lower drive or clutch element and upper drive or clutch element. The turret or turn-table is then locked in place the turret or turn-table locking assembly. Finally, the clutch assembly is engaged and the tool drive motor and the drive linkage rotate the tool drive shaft to rotate the selected tool assembly and tool to finish the corrective lens.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DESCRIPTION OF THE PREFERRED EMBODIMENT

Figure 1:
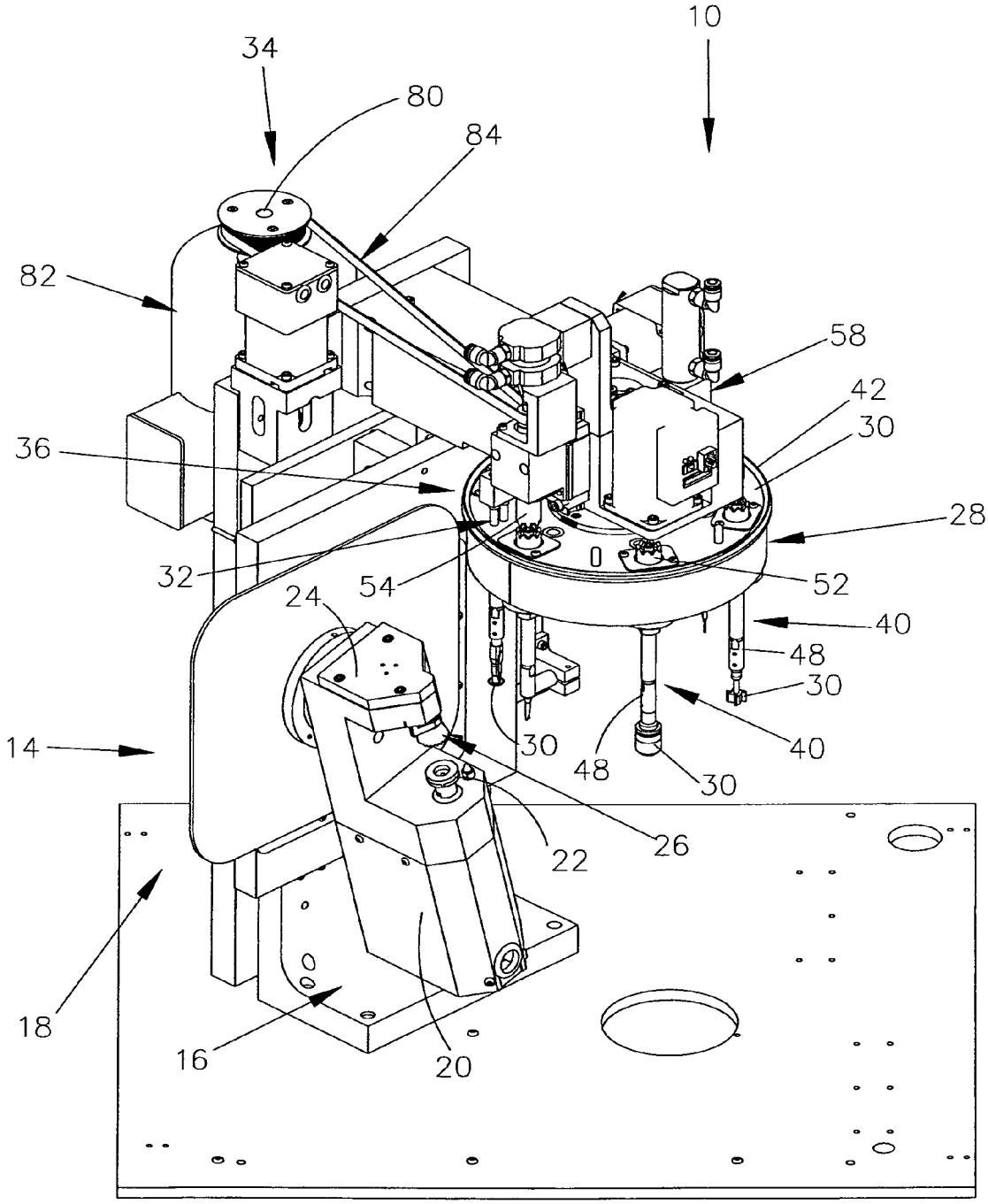
FIG. 1 is a front perspective view of the tool operating assembly and lens operating assembly of the present invention.
Figure 2:
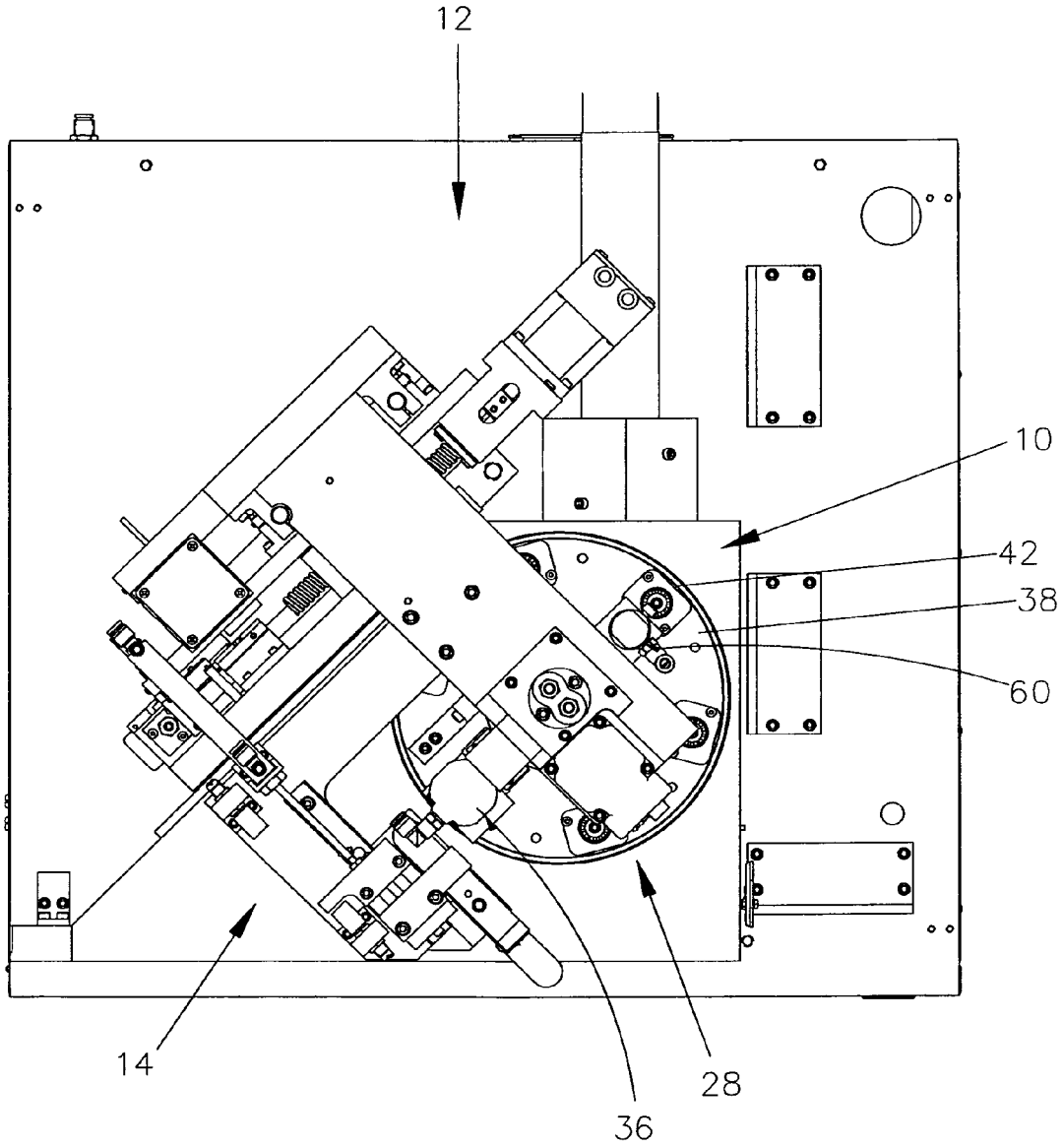
FIG. 2 is a top view of the tool operating assembly and lens operating assembly of the present invention.
Figure 3:
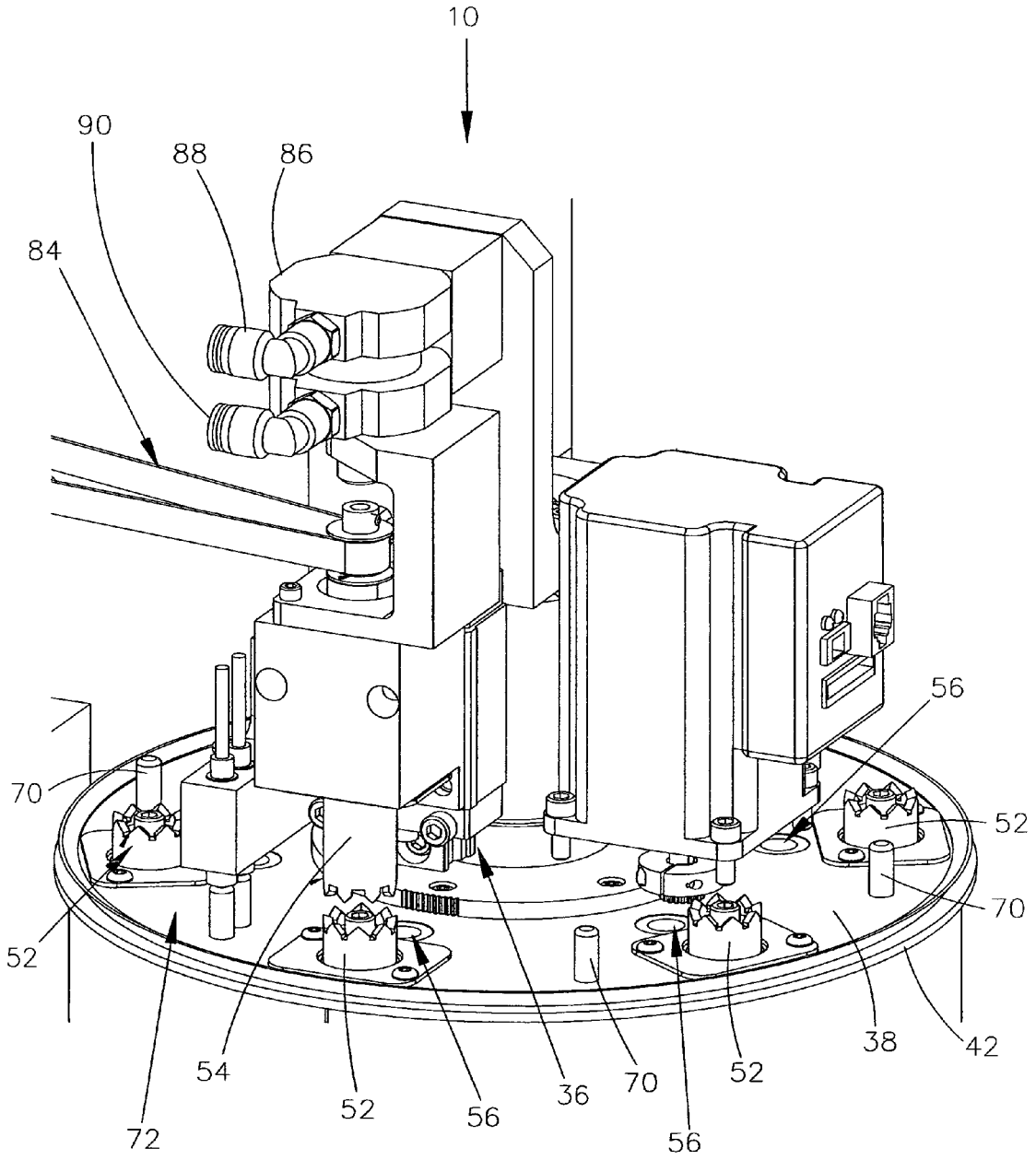
FIG. 3 is a perspective front view of the tool operating assembly of the present invention.
Figure 4:
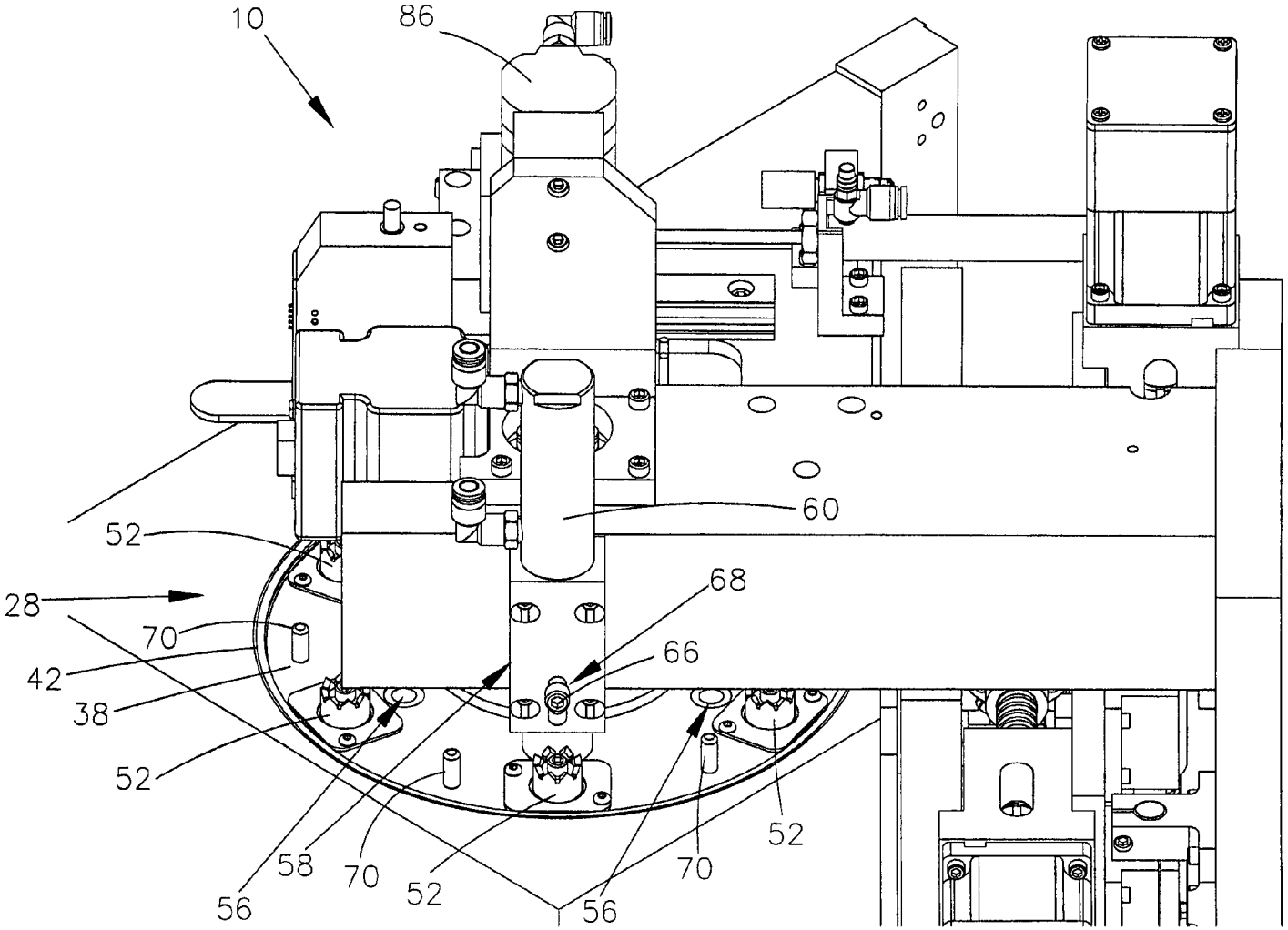
FIG. 4 is a perspective side view of the tool operating assembly of the present invention.

As shown in FIGS. 1 and 2, the present invention relates to a tool operating assembly generally indicated as 10 for a lens shaping machine generally indicated as 12 including a lens operating assembly generally indicated as 14 to finish the peripheral edge or edge portion of a corrective lens (not shown) disposed in operative relationship relative to the tool operating assembly 10 within a sealed edging or finishing chamber of a cabinet (not shown). The lens shaping machine 12 is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

As best shown in FIG. 1, the lens operating assembly 14 comprises a lens support assembly generally indicated as 16 to support the corrective lens (not shown) to be finished and a multi-axis lens positioning assembly generally indicated as 18 to move the corrective lens (not shown) supported on the lens support assembly 16 relative to the tool operating assembly 10 during the finishing operation.

As best shown in FIG. 1, the lens support assembly 16 comprises a lower lens support 20 including a lower lens holder 22 and an upper lens support 24 including an upper lens holder 26 to clamp the corrective lens (not shown) therebetween during the finishing operation.

As shown in FIG. 1, the multi-axis lens positioning assembly 18 comprises a first or vertical positioning subassembly, a second or horizontal positioning subassembly and a third or rotational positioning subassembly to move the lens support assembly 16 and corrective lens (not shown) vertically, horizontally and rotationally respectively relative to the tool operating assembly 10 during the finishing operation as depicted by the directional arrows.

As shown in FIGS. 1 through 5, the tool operating assembly 10 comprises a multi-station tool support assembly generally indicated as 28 to selectively position one of a plurality of tools each indicated as 30 at a finishing station or location 32 adjacent the lens operating assembly 14 to engage the peripheral edge or edge portion of the corrective lens (not shown) to be finished, a tool drive assembly generally indicated as 34 to rotate the selected tool 20 positioned at the finishing station or location 32 during the finishing operation and a clutch assembly generally indicated as 36 to operatively couple the selected tool 30 and the tool drive assembly 34 to rotate the selected tool 30 during the finishing operation.

Figure 5:
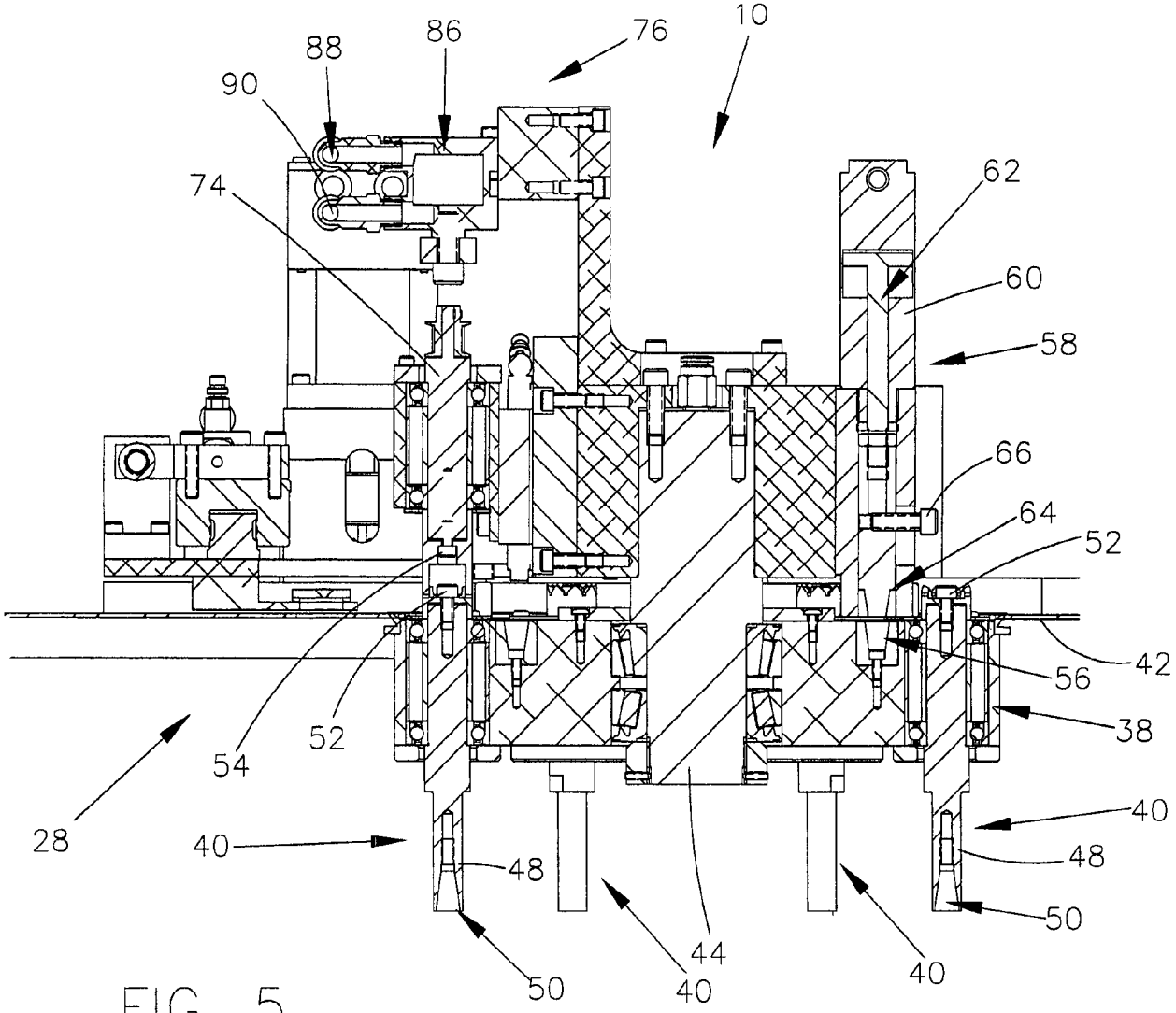
FIG. 5 is a cross-sectional side view of the tool operating assembly of the present invention.

As shown in FIG. 5, the multi-station tool support assembly 28 comprises a turret or turn-table 38 having a plurality of tool assemblies each generally indicated as 40 rotatably mounted thereto within a substantially circular shroud or apron 42 on a substantially vertical drive shaft 44 coupled to a step motor (not shown) to selectively position one of the tools 30 at the finishing position or station 32.

As shown in FIG. 5, each tool assembly 40 comprises a tool holder 48 including a tool recess 50 formed in the lower portion thereof to couple a tool 30 thereto and a lower drive or clutch element 52 such as a serrated or notched crown extending above the turret or turn-table 38 affixed to the upper portion of the corresponding tool holder 48 to engage a similarily configured upper drive or clutch element 54 when the selected tool assembly 40 is located or positioned at the finishing station 32 to cooperatively form a portion of the clutch assembly 36 to rotate the selected tool 30 to finish the peripheral edge or edge portion of the corrective lens (not shown).

The multi-station tool support assembly 28 further includes a turret lock corresponding to each tool assembly 40. Specifically, a lock receiver 56 such as a tapered recess is formed in the turret or turn-table 38 adjacent each tool assembly 40 to cooperate with a turret or turn-table locking assembly generally indicated as 58 operable in a locked position and an unlocked position to lock the turret or turn-table 38 against rotation when in the locked position and the appropriate or selected tool 30 and tool assembly 40 are positioned or located at the finishing station 32. The turret or turn-table locking assembly 58 comprises a lock cylinder 60 and a lock piston 62 combination coupled to a pressurized air source (not shown) to selectively move the piston 62 up and down to move a tapered locking pin 64 into the appropriate lock receiver 56 opposite the finishing station 32 when the appropriate tool 30, tool assembly 40 and lower clutch element 52 are aligned with the finishing station 32 when the locked or down position. The turret or turn-table locking assembly 58 further includes a manual positioning device comprising a finger knob 66 extending through a substantially vertical slot 68 attached to or engaged with the lock piston 62.

In addition, a tool position sensing device 70 is positioned or disposed adjacent each tool assembly 40 each having a discrete identifier to cooperate with a tool assembly position sensing device 72 disposed adjacent the finishing station 32 to indicate the rotational position of the turret or turn-table 38 and the tool assemblies 40 relative to the finishing station 32 to assure the proper tool 30 is positioned or located at the finishing station 32.

As shown in FIGS. 1 and 5, the tool drive assembly 34 comprises a substantially vertical tool drive shaft 74 disposed in vertical alignment relative to the finishing station 32 having the upper drive or clutch element 54 coupled to the lower position thereof and movable between an upper position and a lower position by a clutch positioning device 76 such that the serrated or notched crown or upper drive or clutch element 54 engages the serrated or notched crown of the lower drive or clutch element 52 of the tool assembly 40 located or positioned at the finishing station 32 when the substantially vertical tool drive shaft 74 is in the lower position. The substantially vertical tool drive shaft 74 is coupled to the output shaft 80 of a tool drive motor 82 by a drive linkage 84 such as a drive belt.

The clutch positioning device 76 comprises a pneumatic clutch cylinder 86 to operatively house a piston (not shown) coupled to the substantially vertical tool drive shaft 74 to move the tool drive shaft 74 and the serrated or notched crown or upper drive or clutch element 54 into and out of operative engagement with the serrated oe notched crown of the lower drive or clutch element 52 by feeding air to one side or the other of the piston (not shown) through air ports 88 and 90 to selectively drive the tool 26 of the tool assembly 40 located at the finishing station 32.

Since the turret or turn-table 38 is driven or rotated by a step motor (not shown), the turret or turn-table 38 is incrementally advanced from one tool assembly 40 to the next tool assembly 40 until the correct tool 30 is sensed by the tool sensing device 70 and tool assembly position sensing device 72 as positioned or located at the finishing station 32 aligning the lower drive or clutch element 52 and upper drive or clutch element 54. The turret or turn-table 38 is then locked in place the turret or turn-table locking assembly 58. Finally, the clutch assembly is engaged and the tool drive motor 82 and the drive linkage 84 rotate the tool drive shaft 74 to rotate the selected tool assembly 40 and tool 30.

The sequence of operation is controlled by a microprocessor or similar state of the art device.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

What is claimed is:

1. A tool operating assembly for a lens shaping machine to finish the peripheral edge of a corrective lens wherein said tool operating assembly is disposed in operative relationship relative to a lens operating assembly comprising a lens support assembly to support the corrective lens to be finished and a multi-axis lens positioning assembly to move the corrective lens relative to said tool operating assembly during the finishing operation to finish the peripheral edge of the corrective lens, said tool operating assembly comprising a multi-station tool support assembly including a plurality of tool assemblies to selectively position one of a plurality of tools in operative position relative to a finishing station to engage the peripheral edge of the corrective lens to be finished wherein each said tool assembly includes a lower drive or clutch assembly and a tool drive assembly to rotate the selected tool positioned at said finishing station during the finishing operation to finish the peripheral edge of the corrective lens, said tool drive assembly includes a clutch assembly to operatively couple the selected tool and said tool drive assembly to rotate the selected tool during the finishing operation wherein said tool drive assembly comprises a substantially vertical tool drive shaft movable between an upper and a lower position disposed in vertical alignment relative to said finishing station having said upper drive or clutch element coupled to the lower portion thereof and movable between an upper position and a lower position by a clutch positioning device such that said upper drive or clutch element engages said lower drive or clutch element of said tool assembly located or positioned at said finishing station when said substantially vertical tool drive shaft is in said lower position to operatively couple the selected tool to said tool drive assembly to rotate the selected tool during the finishing operation.

2. The tool operating assembly of claim 1 wherein said multi-station tool support assembly comprises a turret or turn-table having a plurality of tool assemblies rotatably mounted thereto within a shroud or apron on a substantially vertical drive shaft coupled to a step motor to selectively position one of the tool at said finishing station.

3. The tool operating assembly of claim 2 wherein each said tool assembly comprises a tool holder including a tool recess formed in the lower portion thereof to couple a tool thereto and a lower drive or clutch element such as a serrated or notched crown extending above said turret or turn-table affixed to the upper portion of the corresponding tool holder to engage a similarly configured upper drive or clutch element when said selected tool assembly is located or positioned at said finishing station to cooperatively form a portion of said clutch assembly to rotate the selected tool to finish the peripheral edge or edge portion of the corrective lens.

4. The tool operating assembly of claim 3 said multi-station tool support assembly includes a turret lock corresponding to each said tool assembly comprising a lock receiver such as a tapered recess formed in said turret or turn-table adjacent each said tool assembly to cooperate with a turret or turn-table locking assembly operable in a locked position and unlocked position to lock said turret or turn-table against rotation when in said locked position and the selected tool and said tool assembly are positioned or located at said finishing station.

5. The tool operating assembly of claim 4 wherein said turret or turn-table locking assembly comprises a lock cylinder and a lock piston combination coupled to a pressurized air source to selectively move said lock piston up and down to move a tapered locking pin into said lock receiver when the tool, tool assembly and lower clutch element are aligned with said finishing station when in the locked or down position.

6. The tool operating assembly of claim 1 wherein said substantially vertical tool drive shaft coupled to the output shaft of a tool drive motor by a drive linkage.

7. The tool operating assembly of claim 6 wherein the clutch positioning device comprises a pneumatic clutch cylinder to operatively house a piston coupled to said substantially vertical tool drive shaft to move said tool drive shaft and said serrated or notched crown or upper drive or clutch element into and out of operative engagement with said serrated or notched crown of the lower drive or clutch element by feeding air to one side or the other of said piston through air ports to rotate the selected tool located at said finishing station.

8. The tool operating assembly of claim 1 wherein said lens shaping machine is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

9. The tool operating assembly of claim 8 wherein said lens support assembly comprises a lower lens support including a lower lens holder and an upper lens support including an upper lens holder to clamp the corrective lens therebetween during the finishing operation.

10. The tool operating assembly of claim 9 wherein said multi-axis lens positioning assembly comprises a first positioning subassembly, a second positioning subassembly and a third positioning subassembly to move said lens support assembly and the corrective lens vertically, horizontally and rotationally respectively relative to said tool operating assembly during the finishing operation.

11. A tool operating assembly for a lens shaping machine to finish the peripheral edge of a corrective lens wherein said tool operating assembly is disposed in operative relationship relative to a lens operating assembly comprising a lens support assembly to support the corrective lens to be finished and a multi-axis lens positioning assembly to move the corrective lens relative to said tool operating assembly during the finishing operation to finish the peripheral edge of the corrective lens, said tool operating assembly comprising a multi-station tool support assembly to selectively position one of a plurality of tools in operative position relative to a finishing station to engage the peripheral edge of the corrective lens to be finished and a tool drive assembly to rotate the selected tool positioned at said finishing station during the finishing operation to finish the peripheral edge of the corrective lens, said tool drive assembly further including a clutch assembly to operatively couple the selected tool and said tool drive assembly to rotate the selected tool during the finishing operation, said multi-station tool support assembly comprises a turret or turn-table having a plurality of tool assemblies rotatably mounted thereto within a shroud or apron on a substantially vertical drive shaft coupled to a step motor to selectively position one of the tools at said finishing station, each said tool assembly comprises a tool holder including a tool recess formed in the lower portion thereof to couple a tool thereto and a lower drive or clutch element such as a serrated or notched crown extending above said turret or turn-table affixed to the upper portion of the corresponding tool holder to engage a similarly configured upper drive or clutch element when said selected tool assembly is located or positioned at said finishing station to cooperatively form a portion of said clutch assembly to rotate the selected tool to finish the peripheral edge or edge portion of the corrective lens, said multi-station tool support assembly further includes a turret lock corresponding to each said tool assembly comprising a lock receiver such as a tapered recess formed in said turret or turn-table adjacent each said tool assembly to cooperate with a turret or turn-table locking assembly operable in a locked position and unlocked position to lock said turret or turn-table against rotation when in said locked position and the selected tool and said tool assembly are positioned or located at said finishing station and said turret or turn-table locking assembly comprises a lock cylinder and a lock piston combination coupled to a pressurized air source to selectively move said lock piston up and down to move a tapered locking pin into said lock receiver when the tool, said tool assembly and said lower clutch element are aligned with said finishing station when in the locked or down position.

12. The tool operating assembly of claim 10 wherein said multi-axis lens positioning assembly comprises a vertical positioning subassembly, a horizontal positioning subassembly and a rotational positioning subassembly to move said lens support assembly and the corrective lens vertically, horizontally and rotationally respectively relative to said tool operating assembly during the finishing operation.

13. The tool operating assembly of claim 1 wherein said turret or turn-table locking assembly further includes a manual positioning device comprising a finger knob extending through a substantially vertical slot attached to or engaged with said lock piston.

14. The tool operating assembly of claim 13 wherein said tool drive assembly comprises a substantially vertical tool drive shaft disposed in vertical alignment relative to said finishing station having said upper drive or clutch element coupled to the lower partion thereof and movable between an upper position and a lower position by a clutch positioning device such that said serrated or notched crown or upper drive or clutch element engages said serrated or notched crown of the lower drive or clutch element of said tool assembly located or positioned at said finishing station when said substantially vertical tool drive shaft is in the lower position.

15. The tool operating assembly of claim 14 wherein said substantially vertical tool drive shaft coupled to the output shaft of a tool drive motor by a drive linkage.

16. The tool operating assembly of claim 14 wherein the clutch positioning device comprises a pneumatic clutch cylinder to operatively house a piston coupled to said substantially vertical tool drive shaft to move said tool drive shaft and said serrated or notched crown or upper drive or clutch element into and out of operative engagement with said serrated or notched crown of the lower drive or clutch element by feeding air to one side or the other of said piston through air ports to rotate the selected tool of said tool assembly located at said finishing station.

17. The tool operating assembly of claim 14 wherein said lens shaping machine is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

18. The tool operating assembly of claim 17 wherein said lens support assembly comprises a lower lens support including a lower lens holder and an upper lens support including an upper lens holder to clamp the corrective lens therebetween during the finishing operation.

19. The tool operating assembly of claim 18 wherein said multi-axis lens positioning assembly comprises a first positioning subassembly, a second positioning subassembly and a third positioning subassembly to move said lens support assembly and the corrective lens vertically, horizontally and rotationally respectively relative to the tool operating assembly during the finishing operation.

20. The tool operating assembly of claim 11 wherein said lens shaping machine is capable of forming straight and angle lens edges such as rimless, grooved, square bevel, 'V' bevel, step bevel, facet and polished as well as straight and angled hole/slot configurations such as blind hole, through hole, slot, notch, countersunk or engraving of lens top surface.

21. The tool operating assembly of claim 20 wherein said lens support assembly comprises a lower lens support including a lower lens holder and an upper lens support including an upper lens holder to clamp the corrective lens therebetween during the finishing operation.

22. The tool operating assembly of claim 21 wherein said multi-axis lens positioning assembly comprises a first positioning subassembly, a second positioning subassembly and a third positioning subassembly to move said lens support assembly and the corrective lens vertically, horizontally and rotationally respectively relative to the tool operating assembly during the finishing operation.

23. The tool operating assembly of claim 19 wherein said multi-axis lens positioning assembly comprises a vertical positioning subassembly, a horizontal positioning subassembly and a rotational positioning subassembly to move said lens support assembly and the corrective lens vertically, horizontally and rotationally respectively relative to said tool operating assembly during the finishing operation.

24. The tool operating assembly of claim 22 wherein said multi-axis lens positioning assembly comprises a vertical positioning subassembly, a horizontal positioning subassembly and a rotational positioning subassembly to move said lens support assembly and the corrective lens vertically, horizontally and rotationally respectively relative to said tool operating assembly during the finishing operation.

25. The tool operating assembly of claim 11 wherein said multi-station tool support assembly further includes a tool position sensing device disposed adjacent each said tool assembly each having a discrete identifier to cooperate with a tool assembly position sensing device disposed adjacent said finishing station to indicate the rotational position of said turret or turn-table and said tool assemblies relative to said finishing station to assure the selected tool is positioned or located at said finishing station.

26. A tool operating assembly for a lens shaping machine to finish the peripheral edge of a corrective lens wherein said tool operating assembly is disposed in operative relationship relative to a lens operating assembly comprising a lens support assembly to support the corrective lens to be finished and a multi-axis lens positioning assembly to move the corrective lens relative to said tool operating assembly during the finishing operation to finish the peripheral edge of the corrective lens, said tool operating assembly comprising a multi-station tool support assembly to selectively position one of a plurality of tools in operative position relative to a finishing station to engage the peripheral edge of the corrective lens to be finished and a tool drive assembly to rotate the selected tool positioned at said finishing station during the finishing operation to finish the peripheral edge of the corrective lens, said multi-station tool support assembly includes a turret lock corresponding to each said tool assembly comprising a lock receiver recess formed in said turret or turn-table adjacent each said tool assembly to cooperate with a turret or turn-table locking assembly operable in a locked position and unlocked position to lock said turret or turn-table against rotation when in said locked position and the selected tool and said tool assembly are positioned or located at said finishing station and wherein said turret or turn-table locking assembly comprises a lock cylinder and a lock piston combination coupled to a pressurized air source to selectively move said lock piston up and down to move a locking pin into said lock receiver when the tool, said tool assembly and said lower clutch element are aligned with said finishing station when in the locked or down position.

* * * * *